US010373600B2

(12) United States Patent
Christoph et al.

(10) Patent No.: US 10,373,600 B2
(45) Date of Patent: Aug. 6, 2019

(54) ACTIVE NOISE CONTROL SYSTEM

(71) Applicant: HARMAN BECKER AUTOMOTIVE SYSTEMS GMBH, Karlsbad (DE)

(72) Inventors: Markus Christoph, Straubing (DE); Michael Wurm, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 296 days.

(21) Appl. No.: 15/104,819

(22) PCT Filed: Dec. 12, 2014

(86) PCT No.: PCT/EP2014/077603
§ 371 (c)(1),
(2) Date: Jun. 15, 2016

(87) PCT Pub. No.: WO2015/091279
PCT Pub. Date: Jun. 25, 2015

(65) Prior Publication Data

US 2016/0314778 A1 Oct. 27, 2016

(30) Foreign Application Priority Data

Dec. 16, 2013 (EP) ..... 13197417

(51) Int. Cl.
*G10K 11/178* (2006.01)

(52) U.S. Cl.
CPC .... *G10K 11/178* (2013.01); *G10K 2210/3016* (2013.01); *G10K 2210/3023* (2013.01);
(Continued)

(58) Field of Classification Search
CPC ..... G10K 11/178; G10K 2210/1282; H04R 2499/13; H04R 3/002; H04R 3/005; H04R 2410/05
(Continued)

(56) References Cited

U.S. PATENT DOCUMENTS 5,408,532 A 4/1995 Yokota et al.
8,600,069 B2 12/2013 Lee et al.
(Continued)

FOREIGN PATENT DOCUMENTS

CN 101354885 A 1/2009
EP 0721179 A2 7/1996
(Continued)

OTHER PUBLICATIONS

Rees et al., "Adaptive Algorithms for Active Sound-Profiling", IEEE Transactions on Speech and Audio Processing, 2006, 9 pages.
(Continued)

*Primary Examiner* — Alexander Jamal
(74) *Attorney, Agent, or Firm* — Brooks Kushman P.C.

(57) ABSTRACT

The present disclosure relates to an active noise control (ANC) system. In accordance with one aspect of the invention, the ANC system includes a plurality of microphones and a plurality of loudspeakers. Each microphone is configured to provide an error signal that represents a residual noise signal. Each loudspeaker is configured to receive a loudspeaker signal and to radiate a respective acoustic signal. The ANC system further includes an adaptive filter bank, which is supplied with a reference signal and configured to filter the reference signal to provide the loudspeaker signals as filtered signals. The filter characteristics of the adaptive filter bank are adapted such that a cost function is minimized. The cost function thereby represents the weighted sum of the squared error signals.

17 Claims, 5 Drawing Sheets

(52) U.S. Cl.
CPC ..... *G10K 2210/3028* (2013.01); *G10K 2210/3032* (2013.01); *G10K 2210/3046* (2013.01)

(58) Field of Classification Search
USPC ..... 381/71.4, 71.8, 71.11, 71.14
See application file for complete search history.

(56) References Cited

U.S. PATENT DOCUMENTS

| | | | | |
|---|---|---|---|---|
| 2010/0014685 | A1 | 1/2010 | Wurm | |
| 2011/0235693 | A1* | 9/2011 | Lee | H04S 7/00 375/224 |
| 2013/0129108 | A1 | 5/2013 | Wurm | |
| 2016/0314778 | A1* | 10/2016 | Christoph | G10K 11/178 |

FOREIGN PATENT DOCUMENTS

| | | | |
|---|---|---|---|
| EP | 1947642 | A1 | 7/2008 |
| EP | 2133866 | A1 | 12/2009 |
| GB | 20149614 | A | 6/1985 |
| JP | H05101306 | A | 4/1993 |
| JP | H05288237 | A | 11/1993 |
| JP | H0651787 | A | 2/1994 |
| JP | H06195091 | A | 7/1994 |
| JP | H07234688 | A | 9/1995 |
| JP | H1153004 | A | 2/1999 |
| JP | 2008203828 | A | 9/2008 |
| JP | 2010244053 | A | 10/2010 |
| JP | 2013109352 | A | 6/2013 |

OTHER PUBLICATIONS

Extended European Search Report for corresponding Application No. 13197417.2, dated Jun. 2, 2014, 6 pages.

International Search Report and Written Opinion for corresponding Application No. PCT/EP2014/077603, dated Feb. 19, 2015, 9 pages.

* cited by examiner

ACTIVE NOISE CONTROL SYSTEM

CROSS-REFERENCE TO RELATED APPLICATION

This application is the U.S. national phase of PCT Application No. PCT/EP2014/077603 filed on Dec. 12, 2014, which claims priority to EP Application No. 13197417.2 filed on Dec. 16, 2013, the disclosures of which are incorporated in their entirety by reference herein.

TECHNICAL FIELD

The present disclosure relates to an active noise control (ANC) system, in particular to a multi-channel ANC system that has an adjustable damping behavior.

BACKGROUND

Disturbing noise—in contrast to a useful sound signal—is sound that is not intended to meet a certain receiver, e.g., a listener's ears. The generation process of noise and disturbing sound signals can generally be divided into three subprocesses: the generation of noise by a noise source, the transmission of noise away from the noise source and the radiation of the noise signal. Suppression of noise may take place directly at the noise source, for example, by means of damping. Suppression of noise may also be achieved by inhibiting or damping the transmission and/or radiation of noise. Noise control methods and systems are increasingly utilized to eliminate or at least reduce the noise radiated into a listening room by means of destructive interference, i.e., by superposing the noise signal and an appropriately controlled compensation signal. Such systems and methods are summarized under the term active noise canceling or active noise control (ANC).

Although it is known that "points of silence" can be achieved in a listening room by superposing a compensation sound signal and the noise signal to be suppressed such that they destructively interfere, a reasonable technical implementation was not feasible until the development of cost-effective, high-performance digital signal processors, which may be used together with an adequate number of suitable sensors (microphones) and actuators (loudspeakers).

Today's systems for actively suppressing or reducing the noise level in a listening room (known as "active noise control" or "ANC" systems) generate a compensation sound signal of the same amplitude and the same frequency components as the noise signal to be suppressed, but with a phase shift of 180° with respect to the noise signal. The compensation sound signal interferes destructively with the noise signal and the noise signal is thus eliminated or dampened at least at certain desired positions within the listening room.

In the case of a motor vehicle, the term noise encompasses, inter alia, noise generated by mechanical vibrations of the fans, engine and components mechanically coupled thereto, as well as wind and tire noise. Modern motor vehicles may have such features as so-called "rear seat entertainment", which presents high-fidelity audio using a plurality of loudspeakers arranged within the passenger compartment of the motor vehicle. In order to improve sound reproduction quality, disturbing noise can be considered in digital audio processing. Besides this, another goal of ANC is to facilitate conversations between people sitting in the rear seats and people sitting in the front seats.

Modern ANC systems depend on digital signal processing and digital filter techniques. A noise sensor (e.g., a microphone) or a non-acoustic sensor (e.g., a rotational speed sensor coupled to the engine of a motor vehicle) may be employed to obtain an electrical reference signal that represents the disturbing noise signal generated by a noise source such as an internal combustion engine of a motor vehicle. This so-called reference signal may be fed to an adaptive filter; the filtered reference signal is then (e.g., after further signal processing and amplification) supplied to one or more acoustic actuators (e.g., loudspeakers), which generate a compensation sound field in phase opposition to the noise within a defined portion of the listening room. Thus, the noise within this defined portion of the listening room can be eliminated or at least dampened. The residual noise signal may be measured by means of one or more microphones. The resulting microphone output signal(s) may be used as an "error signal" that is fed back to the adaptive filter. The filter coefficients of the adaptive filter may then be modified such that a norm (e.g., the power) of the (e.g., multi-dimensional) error signal is minimized.

A known digital signal processing method frequently used in adaptive filters is an enhancement of the known least mean squares (LMS) method for minimizing the error signal, or the power of the error signal to be precise. These enhanced LMS methods are the filtered-x LMS (FXLMS) algorithm or modified versions thereof, as well as related methods such as the filtered-error LMS (FELMS) algorithm. A model that represents the acoustic path(s) from the acoustic actuator(s) to the error signal sensor(s) (e.g., an error microphone) is used to implement the FXLMS (or any related) algorithm. This acoustic path, or paths in the multi-channel case, from the loudspeaker(s) to the error microphone(s) is usually referred to as the secondary path of the ANC system, whereas the acoustic path(s) from the noise source to the error microphone(s) is/are usually referred to as the primary path of the ANC system.

ANC systems are usually designed to achieve maximum damping throughout the spectral operational range, which is achieved by minimizing the power of the error signal using the aforementioned LMS methods. Particularly in multi-channel ANC systems, the residual power of the noise (i.e., the error signal) may vary depending on the operating point of the ANC system (e.g., on the current rotational speed of a car engine in the case of an automobile application). In automobile applications, the noise spectrum depends heavily on the rotational speed (measured in rotations per minute, or rpm) of the engine; the spectrum of the noise thus usually has a maximum at a fundamental frequency (or a related higher harmonic), which corresponds to the rotational speed of the engine. At a rotational speed of 2,400 rpm, the fundamental frequency may be, for example, 40 Hz (and 50 Hz at 3000 rpm and so on). The achievable damping (attenuation) of the noise and thus the residual power of the noise may vary depending on the fundamental frequency (i.e., the rotational speed) that may perceived as unpleasant by a listener. There is thus a need for an improved ANC system that eliminates or at least alleviates the mentioned variations of residual noise.

SUMMARY

An active noise control (ANC) system is described herein. In accordance with one embodiment the ANC system includes a plurality of microphones. Each microphone is configured to provide an error signal which represents a residual noise signal. The ANC system also includes a plurality of loudspeakers, each of which is configured to receive a loudspeaker signal and radiate a respective acoustic signal. An adaptive filter bank is supplied with a reference signal and configured to filter the reference signal. The adaptive filter bank provides, as filtered signals, the loudspeaker signals, wherein the filter characteristics of the adaptive filter bank are adapted such that a cost function is minimized. The cost function represents the weighted sum of the squared error signals.

Furthermore, an ANC method is described. In accordance with another embodiment of the invention the method includes providing a reference signal, which represents noise at a noise source position and measuring a plurality of error signals at a respective plurality of listening locations at which noise is to be reduced. A cost function is calculated, which represents the weighted sum of the squared error signals. A plurality of loudspeaker signals are supplied to a respective plurality of loudspeakers that radiate corresponding acoustic signals that superpose with the noise at the listening positions; The reference signal is filtered using an adaptive filter bank to provide the loudspeaker signals as filtered signals, wherein the filter characteristics used for filtering are adapted such that the cost function is minimized.

Moreover, a computer program product is disclosed. When executed on a signal processor, the computer program performs an ANC method. In accordance with another embodiment of the invention the computer-controlled method includes providing a reference signal, which represents noise at a noise source position and measuring a plurality of error signals at a respective plurality of listening locations at which noise is to be reduced. A cost function is calculated, which represents the weighted sum of the squared error signals. A plurality of loudspeaker signals are supplied to a respective plurality of loudspeakers that radiate corresponding acoustic signals that superpose with the noise at the listening positions; The reference signal is filtered using an adaptive filter bank to provide the loudspeaker signals as filtered signals, wherein the filter characteristics used for filtering are adapted such that the cost function is minimized.

Other systems, methods, features and advantages will be, or will become, apparent to one with skill in the art upon examination of the following figures and detailed description. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

An active noise control (ANC) system may improve music reproduction or speech intelligibility in the interior of a motor vehicle, or the operation of an active headset by suppressing undesired noises to increase the quality of presented acoustic signals. The basic principle of such active noise control systems is based on the superposition of an existing undesired disturbing signal (i.e., noise) with a compensation signal generated by the ANC system. The compensation signal is superposed in phase opposition with the undesired disturbing noise signal, thus yielding destructive interference. In an ideal case, a complete elimination of the undesired noise signal is thereby achieved. However, a residual noise usually still remains, which one or more microphones pick up at one or more listening positions. The signals obtained by the microphones may be used to control the operation of the ANC system.

Figure 1:
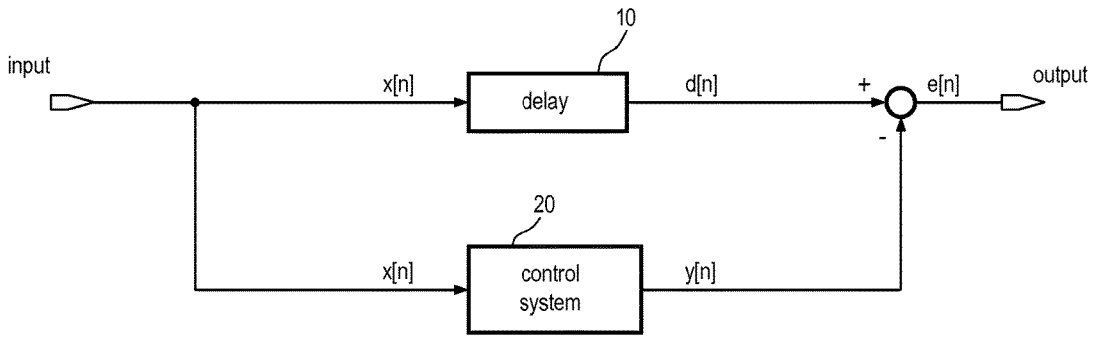
FIG. 1 is a simplified diagram of a feedforward structure.
Figure 2:
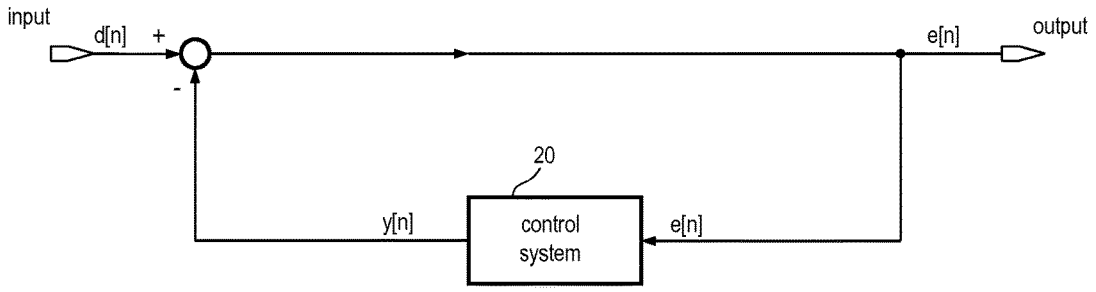
FIG. 2 is a simplified diagram of a feedback structure.

In a feedforward ANC system, a signal that is correlated with the undesired disturbing noise (often referred to as reference signal) is used to generate one or more compensation signals, which are supplied to respective actuators, i.e., loudspeakers. If, however, the compensation signal is not derived from a measured reference signal correlated to the disturbing noise, but is derived only from the system response, a feedback ANC system is present. In practice, the system represents the overall transmission path from the noise source to the listening position(s) at which noise cancellation is desired. The system response to a noise input (represented by the reference signal) from a noise source is represented by at least one microphone output signal, which is fed back via a control system to the loudspeaker(s) generating "anti-noise" to suppress the actual noise signal in the desired position. FIGS. 1 and 2 illustrate, by means of basic block diagrams, a feedforward structure (FIG. 1) and a feedback structure (FIG. 2) used to generate a compensation signal to at least partly compensate for (or ideally eliminate) the undesired disturbing noise signal. In these figures, the reference signal, which represents the noise signal at the location of the noise source, is denoted with x[n]. The resulting disturbing noise at the listening position, where noise cancellation is desired, is denoted with d[n]. The compensation signal destructively superposing disturbing noise d[n] at the listening position is denoted with y[n], and the resulting error signal (i.e., residual noise) d[n]−y[n] is denoted with e[n].

Feedforward systems may provide more effectiveness than feedback arrangements, in particular due to the possibility of the broadband reduction of disturbing noises. This is a result of the fact that a signal representing the disturbing noise (i.e., reference signal x[n]) may be directly processed and used to actively counteract disturbing noise signal d[n]. Such a feedforward system is illustrated in FIG. 1 in an exemplary manner.

FIG. 1 illustrates the signal flow in a basic feedforward structure. Input signal x[n] (e.g., the noise signal at the noise source or a signal derived therefrom and correlated thereto) is supplied to primary path system 10 and control system 20. Input signal x[n] is often referred to as reference signal x[n] for active noise control. Primary path system 10 may basically impose a delay on input signal x[n], due, for example, to the propagation of the noise from the noise source to that portion of the listening room (i.e., the listening position), where suppression of the disturbing noise signal should be achieved (i.e., the desired "point of silence"). The delayed input signal is denoted with d[n] and represents the disturbing noise to be suppressed at the listening position. In control system 20, reference signal x[n] is filtered such that the filtered reference signal y[n], when superposed with disturbing noise signal d[n], compensates for the noise due to destructive interference in the desired portion of the listening room. The output signal of the feedforward structure of FIG. 1 may be regarded as error signal e[n], which is a residual signal comprising the signal components of disturbing noise signal d[n] that were not suppressed by the superposition with filtered reference signal y[n]. The signal power of error signal e[n] (i.e., the power of the residual noise) may be regarded as a quality measure of the achieved noise cancellation.

In feedback systems, the effect of a noise disturbance on the system must initially be awaited. Noise suppression (active noise control) can only be performed when a sensor determines the effect of the disturbance. An advantageous effect of feedback systems is that they can be effectively operated even if a suitable signal (i.e., a reference signal) correlating with the disturbing noise is not available to control the operation of the ANC system. This is the case, for example, when applying ANC systems in environments that are not known a priori and where specific information about the noise source is not available.

The principle of a feedback structure is illustrated in FIG. 2. According to FIG. 2, signal d[n], which is undesired acoustic noise, is suppressed using a filtered signal (compensation signal y[n]) provided by feedback control system 20. The residual signal (error signal e[n]) serves as an input for the feedback loop, i.e., control system 20.

In a practical use, ANC systems are implemented using adaptive filters, because the noise level and the spectral composition of the noise to be reduced may also be subject to variations caused by changing ambient conditions. For example, when ANC systems are used in motor vehicles, the changes of the ambient conditions can be caused by different driving speeds (wind noises, tire noises), by different load states and engine speeds (rpm) or by one or a plurality of open windows. Moreover, the transfer functions of the primary and secondary path systems may change over time.

An unknown system may be iteratively estimated by means of an adaptive filter. The filter coefficients of the adaptive filter are thereby modified such that the transfer characteristic of the adaptive filter approximately matches the transfer characteristic of the unknown system. In ANC applications, digital filters are used as adaptive filters: for example, finite impulse response (FIR) filters or infinite impulse response (IIR) filters whose filter coefficients are modified in accordance with a given adaptation algorithm.

The adaptation of the filter coefficients is a recursive process that permanently optimizes the filter characteristic of the adaptive filter by minimizing an error signal that is essentially the difference between the output of the unknown system and the adaptive filter, wherein both are supplied with the same input signal. While a norm (e.g., the power) of the error signal approaches zero, the transfer characteristic of the adaptive filter approaches the transfer characteristic of the unknown system. In ANC applications, the unknown system may thereby represent the path of the noise signal from the noise source to the spot where noise suppression should be achieved (primary path). The noise (represented by reference signal x[n]) is thereby "filtered" by the transfer characteristic of the signal path, which—in the case of a motor vehicle—essentially comprises the passenger compartment (primary path transfer function). The primary path may additionally comprise the transmission path from the actual noise source (the engine, tires, etc.) to the car body and passenger compartment; it may also comprise the transfer characteristics of the used microphones.

Figure 3:
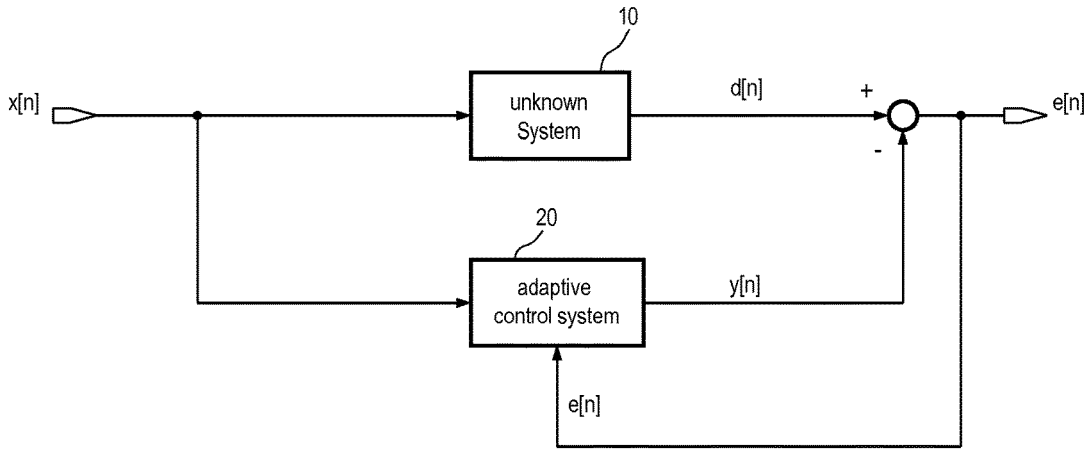
FIG. 3 is a block diagram illustrating the basic principle of an adaptive filter.

FIG. 3 generally illustrates the estimation of unknown system 10 by means of adaptive filter 20. Input signal x[n] is supplied to unknown system 10 and adaptive filter 20. The output signal of unknown system d[n] and the output signal of adaptive filter y[n] are destructively superposed. The resulting residual signal (error signal e[n]) is fed back to the adaptation algorithm implemented in adaptive filter 20. A least mean square (LMS) algorithm, for example, may be employed to calculate modified filter coefficients such that a norm (e.g., the power) of error signal e[n] is minimized. In this case, an optimal suppression of output signal d[n] of unknown system 10 is achieved, and the transfer characteristics of adaptive control system 20 match the transfer characteristics of unknown system 10.

The LMS algorithm provided an approximate solution of the least mean squares problem, which is the mathematical equivalent to a minimization task, as it is often used when utilizing adaptive filters, which are realized in digital signal processors, for example. The algorithm is based on the method of the steepest descent (gradient descent method), and it computes the gradient in a simple manner. The algorithm thereby operates in a time-recursive manner. That is, with each new data set, the algorithm is run through again and the solution is updated. Due to its relatively low complexity and its small memory requirement, the LMS algorithm is often used for adaptive filters and adaptive control, which are realized in digital signal processors. Further methods that may be used for the same purpose include, inter alia, the following: recursive least squares, QR decomposition least squares, least squares lattice, QR decomposition lattice (or gradient adaptive lattice), zero-forcing, stochastic gradient, etc. In active noise control arrangements, the filtered-x LMS (FXLMS) algorithm and its modifications and extensions are quite often used as special embodiments of the LMS algorithm. For example, such a modification could be the modified filtered-x LMS (MFXLMS) algorithm.

Figure 4:
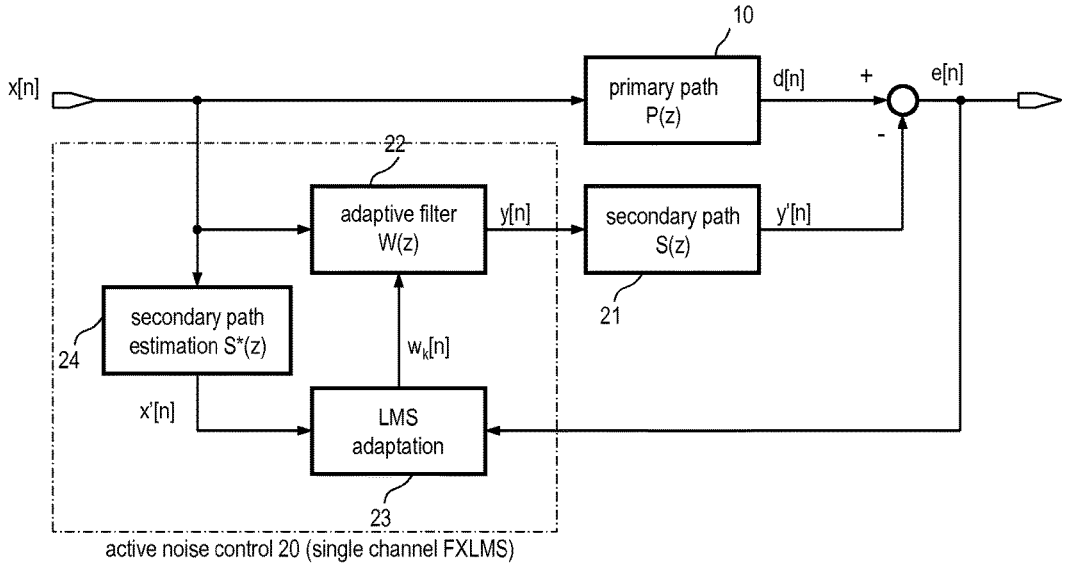
FIG. 4 is a block diagram illustrating a single-channel active noise control system using the filtered-x LMS (FX-LMS) algorithm.

The basic structure of an ANC system employing the FXLMS algorithm is illustrated in FIG. 4 in an exemplary manner. It also illustrates the basic principle of a digital feedforward active noise control system. To simplify matters, components such as amplifiers, analog-digital converters and digital-analog converters, which are required for actual realization, are not illustrated herein. All signals are denoted as digital signals with the time index n placed in squared brackets.

The model of the ANC system of FIG. 4 comprises primary path system 10, which has the (discrete time) transfer function P(z); transfer function P(z) represents the transfer characteristics of the signal path between the noise source and the portion of the listening room where the noise should be suppressed. It further comprises adaptive filter 22, which has filter transfer function W(z), and adaptation unit 23 to (recursively) calculate an optimal set of filter coefficients $w_k=(w_0, w_1, w_2, \ldots)$ for adaptive filter 22. Secondary path system 21, which has transfer function S(z), is arranged downstream of adaptive filter 22 and represents the signal path from the loudspeaker radiating compensation signal y[n] provided by adaptive filter 22 to the portion of the listening room where noise d[n] should be suppressed. The secondary path comprises the transfer characteristics of all components downstream of adaptive filter 21: for example, amplifiers, digital-analog converters, analog-digital converters, loudspeakers, acoustic transmission paths and microphones. When using the FXLMS algorithm for the calculation of the optimal filter coefficients, an estimation S'(z) (system 24) of secondary path transfer function S(z) is used. Primary path system 10 and secondary path system 21 are "real" systems, essentially representing the physical properties of the listening room, whereas the other transfer functions are implemented in a digital signal processor.

Input signal x[n] represents the noise signal generated by a noise source and is therefore often referred to as reference signal. It can be measured, for example, by an acoustic or non-acoustic sensor (e.g., a rotational speed sensor). Input signal x[n] is conveyed to a listening position via the primary path. In the model of FIG. 4, primary path system 10 provides disturbing noise signal d[n] as an output at the listening position where noise cancellation is desired. Reference signal x[n] is further supplied to adaptive filter 22, which provides filtered signal y[n]. Filtered signal y[n] is supplied to secondary path system 21, which provides modified filtered signal (i.e., compensation signal) y'[n] that destructively superposes with disturbing noise signal d[n] at the desired listening position. The adaptive filter therefore has to impose an additional 180-degree phase shift on the signal path. The result of the superposition is a measurable residual signal referred to as error signal e[n]. This error signal is used to control the adaptation process of adaptation unit 23. For calculating updated filter coefficients $w_k$, estimated model S'(z) of secondary path transfer function S(z) is used. In the illustrated example, the estimation S'(z) is used to compensate for the decorrelation between filtered reference signal y[n] and compensation signal y'[n] due to the signal distortion along the secondary path. Estimated secondary path transfer function S'(z) also receives input signal x[n] and provides a modified reference signal x'[n] to adaptation unit 23.

The function of the algorithm is summarized below. Due to the adaptation process, the overall (open loop) transfer function W(z)·S(z) of the series connection of adaptive filter W(z) and secondary path transfer function S(z) approaches primary path transfer function P(z), wherein an additional 180-degree phase shift is imposed on the signal path of adaptive filter 22; disturbing noise signal d[n] (output of primary path 10) and compensation signal y'[n] (output of secondary path 21) thus superpose destructively in the desired portion of the listening room.

Residual error signal e[n], which may be measured by a microphone, is supplied to adaptation unit 23 and modified input signal x'[n], which is provided by estimated secondary path transfer function S'(z). Adaptation unit 23 is configured to recursively calculate filter coefficients $w_k$ of adaptive filter transfer function W(z) from modified reference signal x'[n] (filtered-x) and error signal e[k] such that a norm (e.g., the power or $L^2$-Norm) of error signal ||e[k]|| approaches a minimum. For this purpose, an LMS algorithm may be a good choice, as already mentioned above. Circuit blocks 22, 23 and 24 together form ANC unit 20, which may be fully implemented in a digital signal processor. Of course, alternatives or modifications of the filtered-x LMS algorithm (such as the filtered-e LMS algorithm) may be applicable.

In practical applications, estimated transfer function S'(z) of the secondary path is not an a priori determined estimation. A dynamic system identification of the secondary path, which adapts itself to changing ambient conditions in real time, may be used to consider the dynamic changes of the actual secondary path S(z) during operation of the ANC system.

Figure 5:
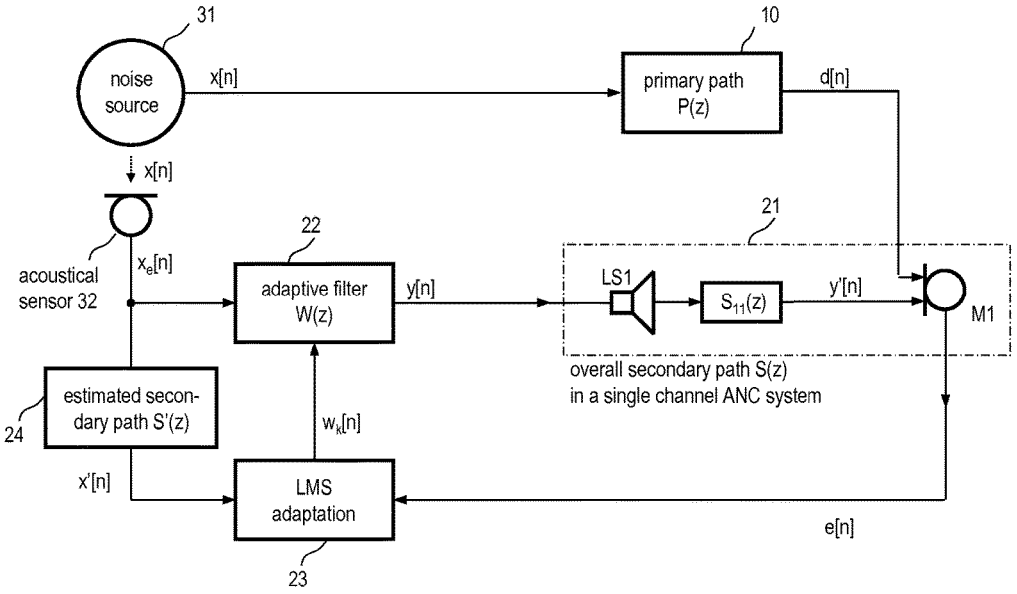
FIG. 5 is a block diagram illustrating the single-channel ANC system of FIG. 4 in more detail.

FIG. 5 illustrates a system for active noise control according to the structure of FIG. 4. To keep things simple, FIG. 5 illustrates a single-channel ANC system as an example. However, the illustrated example may easily be generalized to multi-channel systems without problems, as will be discussed further below. In addition to FIG. 4, which shows only the basic principle, the system of FIG. 5 illustrates the following: noise source 31 generating the input noise signal (i.e., reference signal x[n]) for the ANC system; loudspeaker LS1 radiating filtered reference signal y[n]; and microphone M1 sensing residual error signal e[n] (residual noise). The noise signal generated by noise source 31 serves as input signal x[n] to the primary path. Output d[n] of primary path system 10 represents noise signal d[n] to be suppressed at the listening position. Electrical representation $x_e[n]$ of input signal x[n] (i.e., the reference signal) may be provided by acoustic sensor 32 (e.g., a microphone or a vibration sensor), which is sensitive in the audible frequency spectrum or at least in a desired spectral range thereof. Electrical representation $x_e[n]$ of input signal x[n] (i.e., the sensor signal) is supplied to adaptive filter 22, and filtered signal y[n] is supplied to secondary path 21. The output signal of secondary path 21 (at the listening position) is compensation signal y'[n] destructively interfering with noise d[n]. The residual signal (residual noise) is measured with microphone 33, whose output signal is supplied to adaptation unit 23 as error signal e[n]. The adaptation unit calculates optimum filter coefficients $w_k[n]$ for adaptive filter 22 (k=0, 1, 2, . . . , N−1, where N is the filter order). For this calculation, the FXLMS algorithm may be used as mentioned above. Since acoustic sensor 32 is capable of detecting the noise signal generated by noise source 31 in a broad frequency band of the audible spectrum, the arrangement of FIG. 5 may be used for broadband ANC applications.

In narrowband ANC applications, acoustic sensor 32 may be replaced by a non-acoustic sensor (e.g., a rotational speed sensor) and a signal generator for synthesizing electrical representation $x_e[n]$ of reference signal x[n]. The signal generator may use the base frequency (fundamental frequency), which is measured with the non-acoustic sensor, and higher order harmonics to synthesize reference signal $x_e[n]$. The non-acoustic sensor may be, for example, a rotational speed sensor that gives information on the rotational speed of a car engine as a main source of noise.

Figure 6:
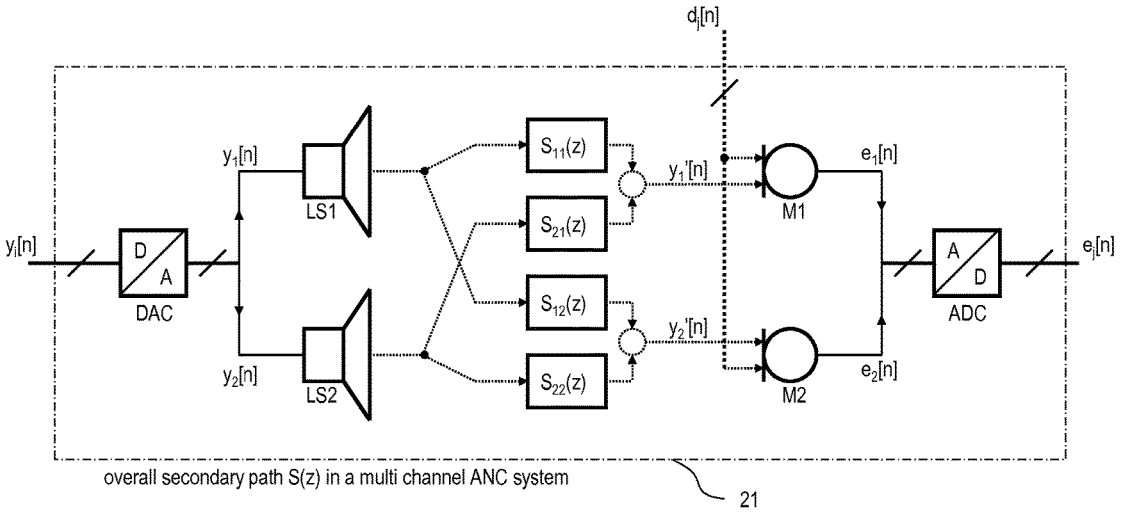
FIG. 6 is a block diagram illustrating the secondary path of a two-by-two multi-channel ANC system.

The overall secondary path transfer function S(z) comprises the following: the transfer characteristics of loudspeaker LS1, which receives adaptive filter output signal y[n]; the acoustic path characterized and represented by transfer function $S_{11}(z)$; the transfer characteristics of microphone M1; and transfer characteristics of such necessary electrical components as amplifiers, analog-digital converters, digital-analog converters, etc. In the case of a single-channel ANC system, only one acoustic signal path is relevant, as illustrated in FIG. 5, and secondary path transfer function S(z) is a scalar function $S_{11}(z)$. In a general multi-channel ANC system that has L loudspeakers $LS_i$ (i=1, . . . , L) and M microphones $M_j$ (j=1, . . . , M), the secondary path is characterized by an L×M transfer matrix of transfer functions $S(z)=S_{ij}(z)$. As an example, a secondary path model is illustrated in FIG. 6 with L=2 loudspeakers and M=2 microphones. In multi-channel ANC systems, adaptive filter 22 comprises one filter $W_i(z)$ for each of the L channels. Adaptive filters $W_i(z)$ provide an L-dimensional filtered reference signal $y_i[n]$ (wherein i=1, . . . , L), each signal component being supplied to the corresponding loudspeaker $LS_i$. Each of the M microphones receives an acoustic signal from each of the L loudspeakers, resulting in a total number of L×M acoustic transmission paths, thus four transmission paths in the example of FIG. 6. Compensation signal y'[n] is, in the multi-channel case, an M-dimensional vector $y_j'[n]$. Each component of vector signal $y_j'[n]$ is superposed with a corresponding disturbing noise signal component $d_j[n]$ at the listening position where the respective microphone $M_j$ is located. The superposition $y_j'[n]+d_j[n]$ yields the M-dimensional error signal $e_j[n]$, wherein compensation signal $y_j'[n]$ is at least approximately in phase opposition to noise signal $d_j[n]$ at the desired listening position. Furthermore, analog-digital converters and digital-analog converters are illustrated in FIG. 6.

Generally, functions and signals with one variable subscript are regarded as vectors. As mentioned, $y_i[n]$ is a vector of L signals $y_i[n]=(y_1[n], \ldots, y_L[n])$. Functions with two variable subscripts are regarded as matrices. That is, $S_{ij}(z)$ is a transfer matrix that has L×M scalar transfer functions $S_{11}(z), \ldots, S_{1M}(z), \ldots, S_{L1}(z), \ldots, S_{LM}(z)$.

Figure 7:
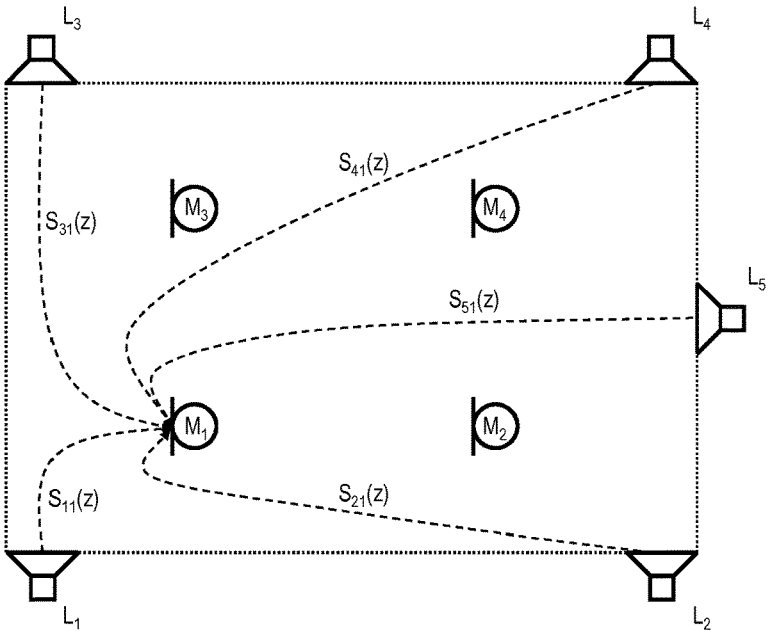
FIG. 7 illustrates the arrangement of loudspeakers and microphones in the interior of an automobile, including the corresponding secondary path transfer functions.

FIG. 7 illustrates matrix $S_{ij}(z)$ of secondary path transfer functions in a multi-channel ANC arrangement using five loudspeakers (L=5) and four microphones (M=4). The transfer functions representing the transfer characteristics from each of the five loudspeakers $L_1$, $L_2$, $L_3$, $L_4$ and $L_5$ to the first microphone $M_1$ are shown, i.e., transfer functions $S_{11}(z)$, $S_{21}(z)$, $S_{31}(z)$, $S_{41}(z)$ and $S_{51}(z)$. The secondary path transfer matrix includes 20 elements (L×M=20) in total. Adaptive filter 22 is a filter bank of L filters that have the filter transfer functions $W_1(z)$, $W_2(z)$, $W_3(z)$, $W_4(z)$ and $W_5(z)$. Adaptive filter bank 22 provides L corresponding output signals $y_1[n]$, $y_2'[n]$, $y_3'[n]$, $y_4'[n]$ and $y_5[n]$, and there are M resulting compensation signals $y_1'[n]$, $y_2'[n]$, $y_3'[n]$ and $y_4'[n]$ at the positions of microphones $M_1$, $M_2$, $M_3$ and $M_4$, respectively. As a result, there are M corresponding error signals $e_1[n]$, $e_2[n]$, $e_3[n]$ and $e_4[n]$, referred to as error vector $e_j[n]$, or simply as (multi-dimensional) error signal $e_j[n]$.

Referring again to FIG. 4, filtered reference signal y[n] calculates as follows:

$$y[n]=x[n]\cdot w_0[n]+x[n-1]\cdot w_1[n]+\ldots+x[n-N+1]\cdot w_{N-1}[n], \tag{1}$$

wherein $w[n]=(w_0[n], w_0[n], \ldots, w_{N-1}[n])$ is the vector of filter coefficients of adaptive filter 22 and represents the (finite) impulse response, which corresponds to filter transfer function W(z). In the present example, the filter order is N. The above equation (1) can be also written as a vector product:

$$y[n]=x_k^T[n]\cdot w_k[n], \tag{2}$$

wherein vector $x_k[n]$ includes the N latest samples of reference signal x[n], i.e., $x_k[n]=(x[n], x[n-1], \ldots x[n-N+1])$. The superscript T denotes the transpose operator (k=0, 1, . . . , N−1).

The example given above applies to a single-channel ANC system, but can also be applied to a multi-channel ANC system with minor modifications. Equation 2 is also valid in the multi-channel case, wherein $w_{ik}[n]$ is a matrix with N×L elements, wherein L is the number of channels (corresponding to the number of loudspeakers). Matrix $w_{ik}[n]$ (i=1, 2, . . . , L; k=0, 1, . . . , N−1) includes the L impulse responses of the L adaptive filter transfer functions $W_i(z)$ associated with the L respective channels (i=1, . . . , L) and vector $x_k[n]$ the N latest samples of the reference signals:

$$w_{ik}[n]=\begin{pmatrix} w_{1,0}[n] & w_{2,0}[n] & \ldots & w_{L,0}[n] \\ w_{1,1}[n] & w_{2,1}[n] & \ldots & w_{L,1}[n] \\ \vdots & \vdots & \ddots & \vdots \\ w_{1,N-1}[n] & w_{2,N-1}[n] & \ldots & w_{L,N-1} \end{pmatrix},$$

and $$x_k[n]=\begin{pmatrix} x[n] \\ x[n-1] \\ \vdots \\ x[n-N-1] \end{pmatrix},$$

and, consequently, matrix product $x_k^T[n]\cdot w_{ik}[n]$ yields vector $y_i[n]$, which includes the current L samples ($y_1[n]$, $y_1[n]$, . . . , $y_L[n]$) associated with the L loudspeakers (channels).

The L filtered reference signals $y_i[n]$ are converted to analog signals, amplified and radiated using the L respective loudspeakers $LS_1$, $LS_2$, . . . $LS_L$, which results in M compensation signals $y_j'[n]=(y_1'[n], y_2'[n], \ldots, y_M'[n])$ at the respective M listening positions (i.e., the positions of microphones $M_1$, $M_2$, . . . , $M_M$). The L filtered reference signals $y_i[n]$ and the M compensation signals $y_j'[n]$ are linked by secondary path transfer matrix $S_{ij}(z)$, which corresponds to a matrix of filter coefficients $s_{ij}[n]$. As a result, the vector of M compensation signals can thus be expressed:

$$y_j'[n]=s_{ij}[n]\cdot y_i[n]. \tag{3}$$

As $y_i[n]=x_k^T[n]\cdot w_{ik}[n]$, the resulting M error signals can be calculated as follows:

$$e_j[n]=d_j[n]-y_j'[n]=d_j[n]-s_{ij}[n]\cdot y_i[n], \tag{4}$$

which is equivalent to the following:

$$e_j[n]=d_j[n]-s_{ij}[n]\cdot(x_k^T[n]\cdot w_{ik}[n]). \tag{5}$$

Equation (5) yields vector $e_j[n]$ of M error signals ($e_1[n]$, $e_2[n]$, . . . , $e_M[n]$), which represent the residual noise at the M listening positions (i.e., the positions of the M microphones). As mentioned, ANC systems make use of least mean square algorithms that minimize a cost function ξ[n], which usually represents the sum of the mean square errors, i.e.:

$$\xi[n]=e_j^T[n]\cdot e_j[n]=e_1^2[n]+e_2^2[n]+\ldots+e_M^2[n]. \tag{6}$$

Figure 8:
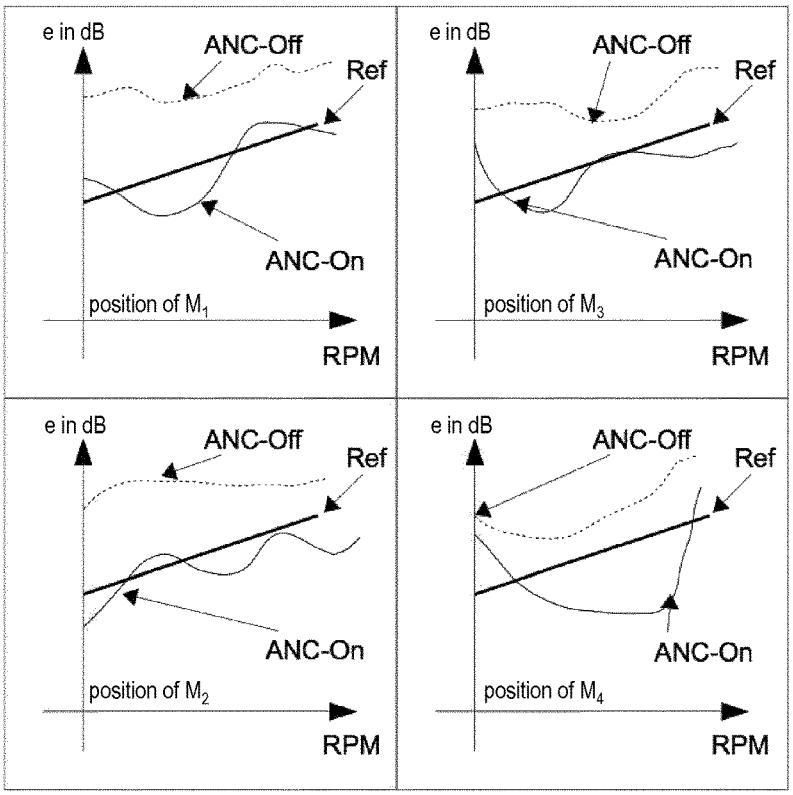
FIG. 8 illustrates the noise levels at different listening locations within a car compartment for activated and deactivated ANC systems.

It can be seen from equation (6) that the ANC system (which makes use of an LMS algorithm) will minimize the total mean square error ξ[n]. This does not necessarily imply that the residual noise is a minimum at each listening position, nor does it imply that the residual noise remains constant at each listening position. However, when using a psycho-acoustic approach, uniform attenuation of the noise and constant attenuation of the noise in different operating points of the ANC system would be more desirable than minimization of the total mean square error. In the example of an automobile ANC system, such different operating points may be regarded as different rotational engine speeds. When the engine speed increases, the residual noise at each listening position may be subject to non-uniform fluctuations, while the total mean square error is continuously minimized. As the total error is at a minimum, the distribution of the residual noise power between the individual error signals $e_j[n]$ may still vary. This effect is illustrated in the four diagrams of FIG. 8, which illustrates the sound pressure level (logarithmic scale) of the (residual) noise at the four different listening positions (which are shown in FIG. 7) over the rotation speed of the car engine. One can see that while ANC is off, the noise levels at the different listening locations vary only slightly while the engine speed is increasing (not to mention an almost linear increase in the noise level). In contrast to this, the residual noise level fluctuates heavily while ANC is on (in addition to a linear increase in the noise level), although at a far lower absolute level than when ANC is off. The lines labelled "Ref" in the diagrams of FIG. 8 represent the desired sound pressure level of the residual noise while ANC is on. However, these desired sound pressure levels may be arbitrarily chosen; FIG. 8 has to be regarded as an example only.

The problem mentioned above may be alleviated, or ideally almost eliminated, by modifying how to calculate cost function $\xi[n]$ (see equation (6)). Such a modified cost function $\xi_{MOD}[n]$ may be calculated using the following formula:

$$\xi_{MOD}[n]=(A_j[n]\cdot e_j[n])^T\cdot e_j[n]=a_1[n]\cdot e_1^2[n]+a_2[n]\cdot e_2^2[n]+\ldots+a_M[n]\cdot e_M^2[n], \quad (7)$$

wherein matrix $A_j[n]$ is a diagonal matrix that includes weight factors $a_j[n]$, which are used to weight the individual error signals $e_j[n]$ (j=1, 2, . . . , M), which contribute to cost function $\xi_{MOD}[n]$.

The weight factors $a_j[n]=(a_1[n], a_2[n], \ldots, a_M[n])$ represent the relation (e.g., difference or ratio) between the respective residual noise power (i.e., square error $e_j^2[n]$) and the predefined reference power (which may be a function of the rotational engine speed, for example). While the residual noise power is higher than a predefined reference power at a specific listening position, the weight factor is higher than one. While the residual noise power is lower than the predefined reference power at the specific listening position, the weight factor is lower than one. The power of the residual noise thus more closely matches the predefined reference power as compared to using a cost function without individual weights $a_j[n]$.

Figure 9:
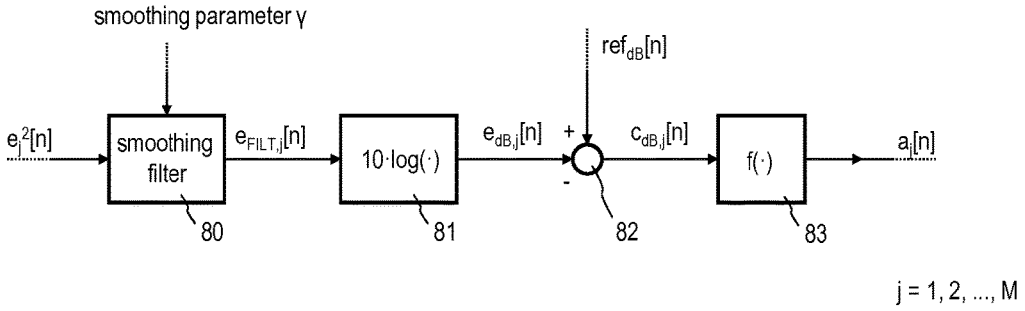
FIG. 9 is a block diagram illustrating the calculation of weighting factors used to calculate a modified cost function used by the LMS algorithm.

FIG. 9 illustrates one exemplary calculation scheme for calculating the mentioned weighting factors $a_j[n]$. First, error signals $e_j[n]$, which are picked up by the microphones at the respective listening positions, are squared and smoothed using smoothing filter 80 (e.g., a moving average filter). The smoothing operation is controlled by smoothing parameter $\gamma$, wherein $\gamma=0$ would mean that no smoothing is provided. As such, the smoothing filter may be regarded as optional. It may be implemented as a simple infinite impulse response (IIR) low-pass filter (e.g., first-order filter) and may reduce excessive fluctuations of the error signal, which may have an undesired impact on the adaptation process. The smoothed, squared error signal is denoted as $e_{FILT,j}[n]$.

Figure 10:
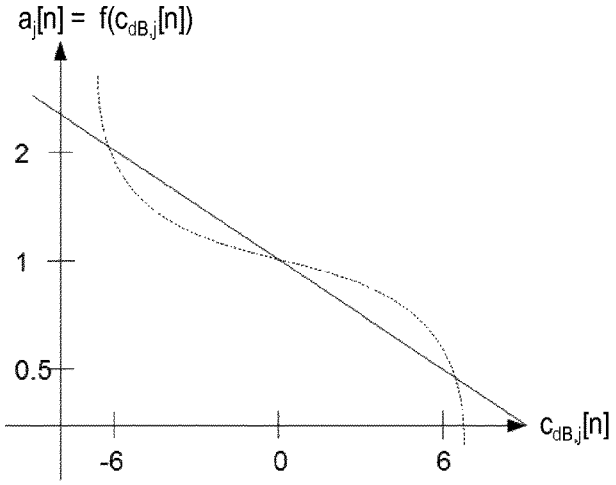
FIG. 10 illustrates a block diagram illustrating an exemplary conversion function used to calculate the weighting factors.

Signal $e_{FILT,j}[n]$ may then be transformed into a logarithmic scale (scaling unit 81). That is, the signal power is provided in decibels (dB) and the error signal is denoted as $e_{dB,j}[n]$. Subtraction unit 82 may be configured to provide the power level difference between the smoothed and squared error signal $e_{FILT,j}^*[n]$ (in dB) and the level of a predefined reference power signal $ref_{dB}[n]$. In the present example, difference $c_{dB}[n]$ is calculated as $ref_{dB}[n]-e_{dB,j}[n]$. The resulting difference $c_{dB}[n]$ is then subject to conversion function f(•), which may be designed to convert difference $c_{dB}[n]$ into a linear scale. The sought weight factor $a_j[n]$ is then provided by $a_j[n]=f(c_{dB}[n])$. However, the calculation scheme of FIG. 9 should only be regarded as an illustrative example. A skilled person will find alternative calculation schemes that essentially yield the same result. FIG. 10 illustrates two examples of a possible conversion function f(•) that may be used to convert difference $c_{dB}[n]$ into an approximately linear scale. The first example maps the interval between −6 and 6 dB to the interval 0.5 to 2.0, which is a linear relationship in a semi-logarithmic scale. The second example illustrates a nonlinear relation between $c_{dB,j}[n]$ and weighting factor $a_j[n]$.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An active noise control (ANC) system that includes:

a plurality of microphones, each microphone being configured to provide an error signal which represents a residual noise signal;

a plurality of loudspeakers, each loudspeaker being configured to receive a loudspeaker signal and radiate a respective acoustic signal; and an adaptive filter bank supplied with a reference signal and configured to filter the reference signal and to provide, as filtered signals, the loudspeaker signals, wherein filter characteristics of the adaptive filter bank are adapted such that a cost function is minimized, the cost function representing a weighted sum of squared error signals, wherein each squared error signal is weighted with a weighting factor that depends on a difference or a ratio between a power level of the error signal and a predefined reference level, and wherein the weighting factor is determined by applying a conversion function.

2. The ANC system of claim 1, wherein the predefined reference level depends on the reference signal.

3. The ANC system of claim 1, wherein the predefined reference level depends on a fundamental frequency of the reference signal.

4. The ANC system of claim 1, wherein the squared error signal is smoothed before calculating the weighting factor.

5. The ANC system of claim 1, wherein the difference is calculated using a logarithmic scale.

6. The ANC system of claim 1, wherein the weighting factor is calculated from the difference by applying the conversion function to the difference.

7. An active noise control (ANC) method that includes the following:

providing a reference signal, which represents noise at a noise source position;

measuring a plurality of error signals at a respective plurality of listening locations at which the noise is to be reduced;

calculating a cost function, which represents a weighted sum of squared error signals;

supplying a plurality of loudspeaker signals to a respective plurality of loudspeakers that radiate corresponding acoustic signals that superpose with the noise at listening positions; and filtering the reference signal using an adaptive filter bank to provide the plurality of loudspeaker signals as filtered signals, wherein filter characteristics used for the filtering are adapted such that the cost function is minimized, and wherein calculating the cost function includes:

weighting each squared error signal with a weighting factor that depends on a difference or a ratio between a power level of the error signal and a predefined reference level, and wherein the weighting factor is determined by applying a conversion function.

8. The ANC method of claim 7, wherein the predefined reference level depends on the reference signal.

9. The ANC method of claim 7, wherein calculating the cost function includes the following:

smoothing the squared error signal before calculating the weighting factor therefrom.

10. The ANC method of claim 7, wherein calculating the cost function includes the following:

calculating the difference between the power level of the error signal and the predefined reference level using a logarithmic scale.

11. A computer program product which, when executed on a signal processor, performs an active noise control (ANC) method that includes the following:

providing a reference signal, which represents noise at a noise source position;

measuring a plurality of error signals at a respective plurality of listening locations at which the noise is to be reduced;

calculating a cost function, which represents a weighted sum of squared error signals;

supplying a plurality of loudspeaker signals to a respective plurality of loudspeakers that radiate corresponding acoustic signals that superpose with the noise at listening positions; and filtering the reference signal using an adaptive filter bank to provide the loudspeaker signals as filtered signals, wherein filter characteristics used for filtering are adapted such that the cost function is minimized, wherein calculating the cost function includes weighting each squared error signal with a weighting factor that depends on a difference or a ratio between a power level of the error signal and a predefined reference level, and wherein the weighting factor is determined by applying a conversion function.

12. An active noise control (ANC) system that includes:

a plurality of microphones, each microphone being configured to provide an error signal which represents a residual noise signal;

a plurality of loudspeakers, each loudspeaker being configured to receive a loudspeaker signal and radiate a respective acoustic signal; and an adaptive filter bank supplied with a reference signal and configured to filter the reference signal and to provide, as filtered signals, the loudspeaker signals, wherein filter characteristics of the adaptive filter bank are adapted to minimize a cost function that represents a weighted sum of squared error signals that is weighted with a weighting factor, wherein the weighting factor depends on a difference or a ratio between a power level of the error signal and a predefined reference level, and wherein the weighting factor is determined by applying a conversion function.

13. The ANC system of claim 12, wherein the predefined reference level depends on the reference signal.

14. The ANC system of claim 12, wherein the predefined reference level depends on a fundamental frequency of the reference signal.

15. The ANC system of claim 12, wherein the squared error signal is smoothed before calculating the weighting factor.

16. The ANC system of claim 12, wherein the difference is calculated using a logarithmic scale.

17. The ANC system of claim 12, wherein the weighting factor is calculated from the difference by applying the conversion function to the difference.

* * * * *